United States Patent [19]

Shewchuk

[11] Patent Number: 4,852,213

[45] Date of Patent: Aug. 1, 1989

[54] RELEASABLE EXTRUDED HINGE

[76] Inventor: Peter Shewchuk, 1055 Shawnmarr Road, Unit 144, Mississauga, Ontario, Canada, L5H 3V2

[21] Appl. No.: 106,595

[22] Filed: Oct. 13, 1987

[51] Int. Cl.[4] ..... E05D 1/06; E05D 9/00

[52] U.S. Cl. ..... 16/266; 16/260; 16/225; 16/269; 16/385; 16/DIG.13; 16/355

[58] Field of Search ..... 16/260, 266, 355, 225, 16/269, 385, DIG. 13

[56] References Cited

U.S. PATENT DOCUMENTS

| | | | |
|---|---|---|---|
| 974,953 | 11/1910 | Darlington | 16/269 |
| 1,666,211 | 4/1928 | Kellogg | 16/355 |
| 1,895,572 | 1/1933 | Kellogg | 296/92 |
| 1,921,261 | 8/1933 | Potter | 16/355 |
| 2,066,444 | 1/1937 | Albert | 16/355 |
| 2,302,661 | 11/1942 | Benson | 16/267 |
| 2,549,110 | 4/1951 | Michael | 16/269 |
| 2,799,890 | 7/1957 | Stavich | 16/269 |
| 3,633,244 | 1/1972 | Grossman | 16/355 |
| 3,863,372 | 2/1975 | Stilling | 40/574 |
| 4,123,822 | 11/1978 | Bentley | 16/355 |
| 4,308,972 | 1/1982 | McReynolds | 220/335 |

FOREIGN PATENT DOCUMENTS

| | | | |
|---|---|---|---|
| 1270987 | 6/1968 | Fed. Rep. of Germany | 16/355 |
| 681771 | 5/1930 | France | 16/355 |
| 1385625 | 5/1965 | France . | |
| 6506353 | 11/1966 | Netherlands . | |
| 746040 | 3/1956 | United Kingdom . | |
| 1252931 | 11/1971 | United Kingdom . | |

*Primary Examiner*—Kenneth J. Ramsey
*Assistant Examiner*—Edward A. Brown
*Attorney, Agent, or Firm*—Krass & Young

[57] ABSTRACT

A pinless releasable hinge assembly has complementary curved mating surfaces on first and second members, one of the members being hingedly swingable along a generally arcuate path relative to the other member which remains stationary from a closed configuration through a plurality of open configurations defined along said arcuate path; at a limiting release configuration in the arcuate path the swingable member is releasably removable but is captive until the limiting release configuration is reached; a resilient gasket associated with one of the members resiliently, sealingly engages an abutment surface on the other member, in the closed configuration; the hinge assembly can be employed for ready release of a door mounted on one of the members, from an opening, at which the other member is mounted; the gasket forms a tight seal which does not interfere with the operation of the hinge or ready release feature.

10 Claims, 2 Drawing Sheets

RELEASABLE EXTRUDED HINGE

BACKGROUND OF THE INVENTION

This invention relates to a hinge assembly, more especially a pinless releaseable hinge assembly, which provides a tight seal.

Pinless hinge assemblies are known such as those described in U.S. Pat. Nos. 1,895,572; 2,066,444; 2,302,661; 3,863,372; 4,308,942; 4,123,822; French Pat. No. 1,385,625; Dutch Patent Specification No. 6,506,353 and U.K. Pat. No. 746,040 and U.K. Pat. No. 1,252,931. These assemblies have various disadvantages including the complex shaping of the parts which limits ease of manufacture, complex assembly, time consuming disassembly and inability to readily form a tight seal between the hinge components.

The present invention overcomes problems associated with prior pinless hinge assemblies, particularly in providing a pinless hinge assembly of simple structure which can be readily pivoted to a quick release configuration, and which provides a tight seal in the closed configuration.

SUMMARY OF THE INVENTION

Thus in accordance with the invention there is provided a pinless releaseable hinge assembly which includes first and second members one being stationary and the other swingable. The first member has a cavity with an inner curved mating surface. An entrance slot to the cavity is formed between a retaining flange at an outer end of the inner surface and an inner end of the inner surface.

The second member has a hooked portion with an outer curved mating surface complementary to the inner mating surface, the hooked portion having an outer end. The outer mating surface smoothly mates with the inner mating surface in a closed configuration of the assembly in which the outer end abuts the retaining flange.

One of the retaining flange and the outer end of the hooked portion is hingedly swingable along a generally arcuate path relative to the other from the closed configuration to define a plurality of open configurations along the arcuate path.

A limiting release configuration in the arcuate path permits the hooked portion to be releaseably removed through the slot; the hooked portion being captive in the cavity between the closed configuration and the limiting release configuration.

A resilient seal member on one of the first and second members resiliently sealingly engages abutment means on the other of the first and second members in the closed configuration.

In a particular embodiment the inner curved surface of the first member is a concave surface and the outer curved surface of the hooked portion is a convex surface.

Either the first or the second member may be the stationary member, the remaining member being the swingable member.

The pinless releaseable hinge assembly of the invention may be used in a variety of environments in which a fully sealed, fluid tight closure is required.

The hinge assembly of the invention may be extruded as an integral part of components of a cabinet, container, housing or other structure in which a door-like member closes an opening. Thus the hinge elements of the assembly may extend the full opening of the door.

Employing the hinge assembly of the invention a door mounted in an opening may be readily adjusted to a variety of open configurations, and may be readily removed from the opening for cleaning, maintenance or other access requirements.

BRIEF DESCRIPTION OF THE DRAWINGS

The invention is illustrated in particular and preferred embodiments by reference to the accompanying drawings in which.

DETAILED DESCRIPTION OF PREFERRED EMBODIMENT

Figure 2:
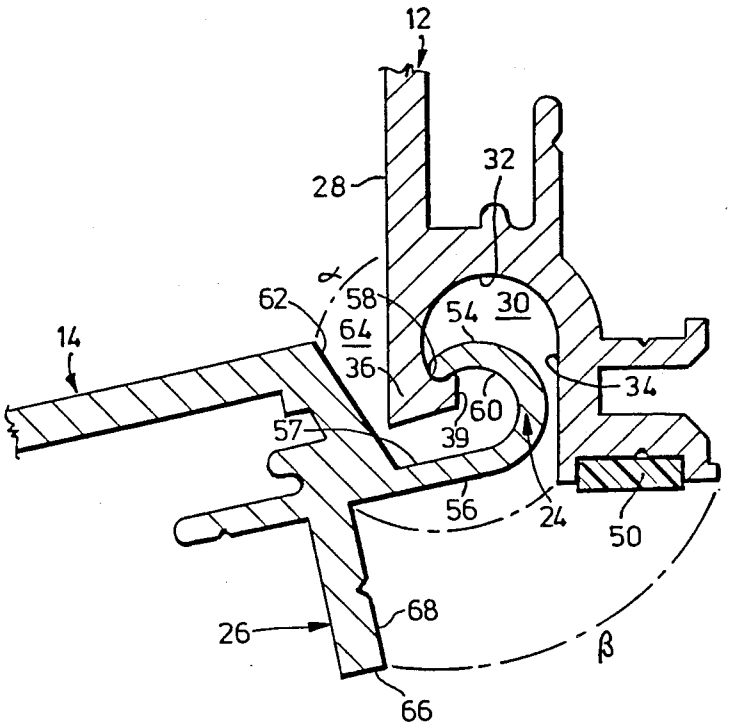
FIG. 2 is a side elevation in cross-section of the assembly of FIG. 1 in the limiting release configuration.
Figure 1:
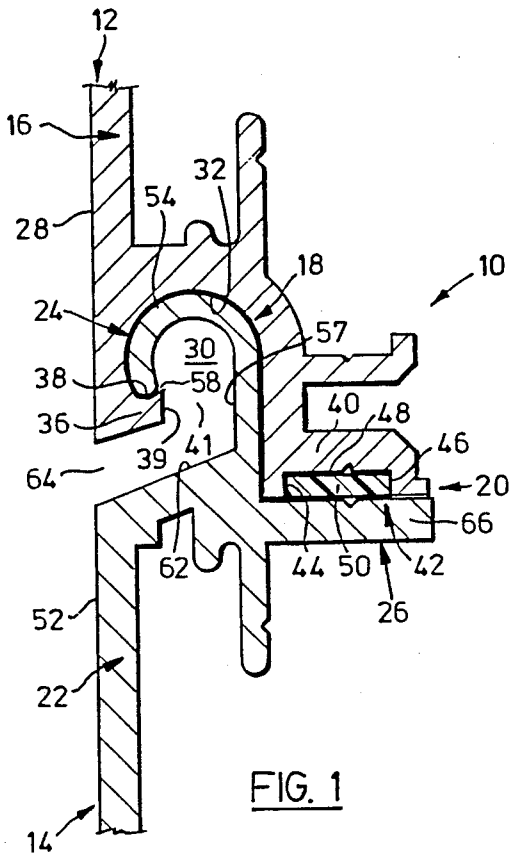
FIG. 1 is a side elevation in cross-section of a hinge assembly of the invention in the closed configuration.

With further reference to FIGS. 1 and 2, a hinge assembly 10 includes a stationary member 12 and a swingable member 14.

Stationary member 12 includes a panel portion 16, a cavity portion 18 and a gasket retaining portion 20.

Swingable member 14 includes a panel portion 22, a hook portion 24 and an abutment portion 26.

Panel portion 16 of stationary member 12 includes a planar surface 28. Cavity portion 18 of stationary member 12 includes a cavity 30 having a concave surface 32 terminating at one end in a flat generally tangential surface 34 and at the other at a retaining flange 36.

Retaining flange 36 has a flange 38 and an upper slide face 39.

An access slot 41 to cavity 30 is defined between slide face 39 and flat surface 34.

Gasket retaining portion 20 includes a flange 40 having therein a channel 42 defined by spaced apart channel walls 44 and 46 and a channel floor 48.

A resilient gasket 50 is housed in channel 42.

Panel portion 22 of swingable member 14 includes a planar surface 52. Hook portion 24 of swingable member 14 has a convex surface 54 terminating at an inner end in a flat generally tangential surface 56 and at the other at outer end 58. A hook slot 60 in hook portion 24 terminates at the inner end in a flat surface 57 opposed to flat surface 56.

Flat surface 57 meets a slot wall 62 which defines with retaining flange 36 a variable slot 64.

Abutment portion 26 includes an abutment flange 66 having a sealing surface 68.

In particular FIG. 1 shows the assembly 10 in a closed configuration in which convex surface 54 smoothly mates with concave surface 32 and flat tangential surface 56 mates with flat tangential surface 34. In this closed configuration planar surfaces 28 and 52 are essentially co-planar and outer end 58 of hook portion 24 engages flange face 38 of retaining flange 36.

In this closed configuration sealing surface 68 is in sealing contact with resilient gasket 50 providing a tight, in particular fluid tight, seal between stationary member 12 and swingable member 14.

Swingable member 14 swings relative to stationary member 12, along an arc $\beta$, with convex surface 54 turning relative to concave surface 32, whereby planar surface 52 is inclined at an angle $\alpha$ to planar surface 28, and retaining flange 36 may progressively enter hook slot 60 and the assembly 10 may assume a variety of open configurations along arc $\beta$ in which hook portion 24 remains captive in cavity 30, exit of hook portion 24 from cavity 30 being prevented by engagement of outer end 58 with flange face 38 even when swingable member 14 is in an extreme position in which convex surface 54 abuts flat tangential surface 34.

As swingable member 14 relative to stationary member 12 flat surface 56 is inclined to, and may be separated from flat surface 34 at angle $\gamma$ such that at any open configuration $\alpha+\gamma=180°$.

In the limiting release configuration illustrated in FIG. 2, planar surfaces 28 and 52 are substantially perpendicular, ($\alpha=90°$) with respect to one another, and in this configuration outer end 58 is able to slide over upper slide face 39 of retaining flange 36 while convex surface 54 slides against flat tangential surface 34. Thus, separating release of the members 12 and 14 does not occur until the 90° configuration is reached.

With particular reference to FIGS. 3 to 6 there is shown a second embodiment of the invention wherein like parts are given similar numbers increased by 100.

Thus, a hinge assembly 110 includes a stationary member 112 and a swingable member 114.

Stationary member 112 includes a planar portion 116, a cavity portion 118 and a gasket retaining portion 120; and swingable member 114 includes a panel portion 122 and a hook portion 124.

Cavity portion 118 includes a cavity 130 having a concave surface 132, terminating at one end in a retaining flange 136.

Hook portion 124 has a convex surface 154 and a slot wall 162 which defines with retaining flange 136 a variable slot 164.

In hinge assembly 110 of FIGS. 3 to 6, gasket retaining portion 120 has an extension 80 having a channel 82 therein housing resilient gasket 150 and hook portion 124 includes a sealing surface 84.

It may be observed that the variable slot 164 in the hinge assembly 110 is significantly larger than the variable slot 64 in hinge assembly 10.

Figure 3:
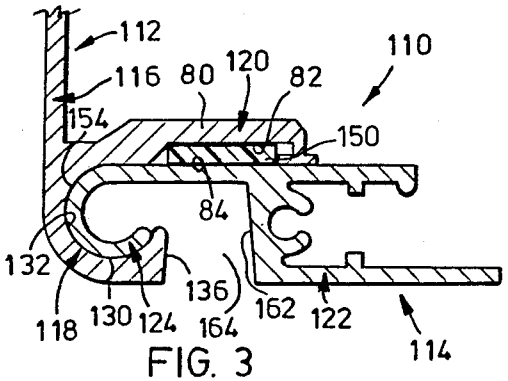
FIG. 3 is a side elevation in cross-section of a hinge assembly of the invention in a second embodiment.

FIG. 3 particularly shows the hinge assembly 110 in the closed configuration in which convex surface 154 smoothly mates with concave surface 132 and sealing surface 84 is sealingly engaged by resilient gasket 150. In this configuration the panel portions 116 and 122 are substantially perpendicular to each other.

Figure 4:
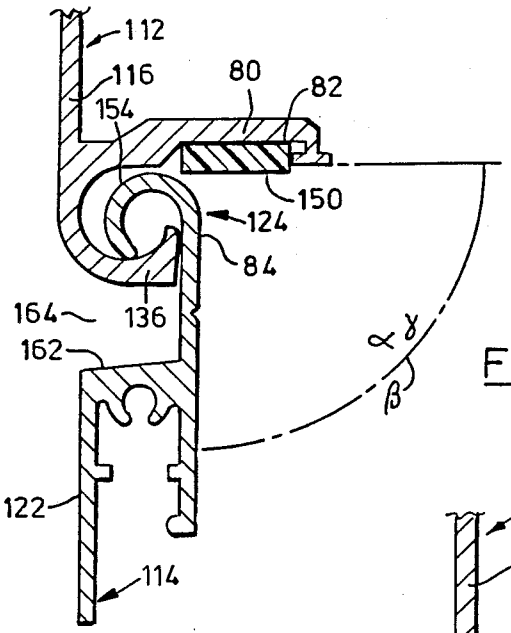
FIG. 4 is a side elevation in cross-section of the assembly of FIG. 3 in an open (90°) configuration.

With reference to FIG. 4 there is shown the hinge assembly 110 in an open configuration in which swingable member 114 has essentially been swung or pivoted through arc $\gamma$ of 90° along an arcuate path $\beta$ and panel portions 116 and 122 are essentially coplanar or in any event parallel.

Figure 5:
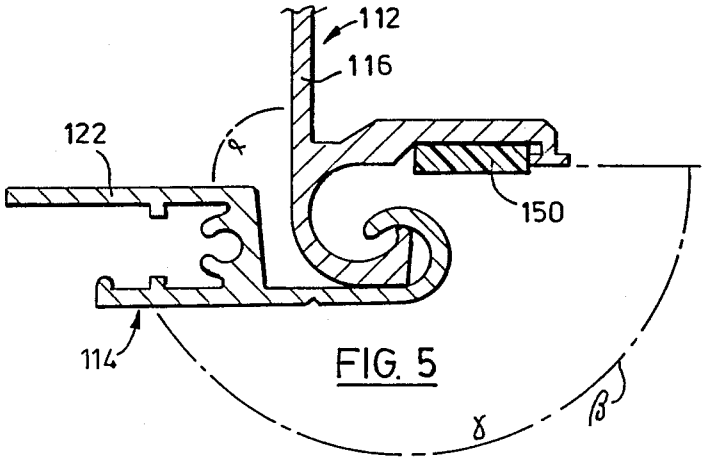
FIG. 5 is a side elevation in cross-section of FIG. 3 in an open (180°) configuration.

With reference to FIG. 5, the assembly 110 is shown in an open configuration in which swingable member 114 has been swung or pivoted along an arcuate path $\beta$ through an arc $\gamma$ of 180° relative to the stationary member 112 and panel portions 116 and 122 are again essentially perpendicular to each other ($\alpha=90°$).

Figure 6:
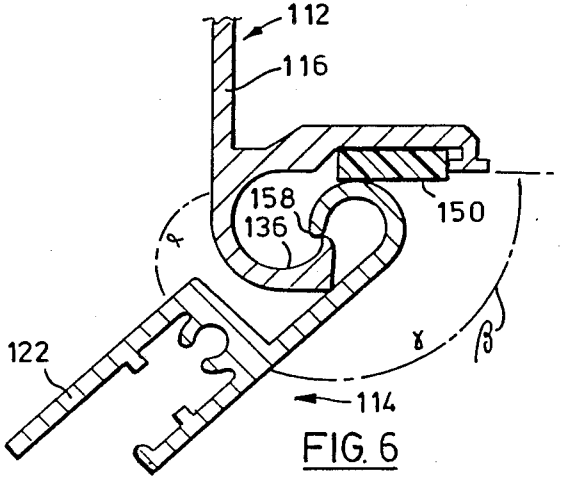
FIG. 6 is a side elevation in cross-section of the assembly of FIG. 3 in the limiting release configuration.

With particular reference to FIG. 6 there is shown the hinge assembly 110 in the limiting release configuration in which swingable member 114 has been swung or pivoted along arcuate path $\beta$ through an arc $\gamma$ of about 135° relative to stationary member 112 and panel portions 116 and 122 are inclined at an angle $\alpha$ of about 135° to each other.

Thus the embodiment of FIGS. 1 and 2 may be especially suitable, for example, when the swingable member 14 is to be mounted on a door of a cabinet, and the stationary member 12 is to be mounted on a front wall of the cabinet which lies in the same plane as the door, in the closed configuration.

The embodiment of FIGS. 3 to 6, on the other hand, is especially suitable for the case in which, for example, the swingable member 114 is to be mounted on a door of a cabinet and the stationary member 112 is to be mounted on a side wall, floor or ceiling of a cabinet which is generally perpendicular to the door in the closed configuration.

Thus the hinge assembly 10 is especially suitable for cabinet in which the door does not accommodate the full front face of the cabinet in which it is disposed, whereas the hinge assembly 110 in FIGS. 3 to 6 is especially suitable for mounting a door in a cabinet when the door constitutes the complete front wall of the cabinet.

It should be understood that the hinge assemblies 10 and 110 may themselves define the walls of the door and the cabinet. Thus, with reference to FIGS. 1 and 2, the panel portions 16 and 22 may represent bordering wall and door of the cabinet in which panel portion 22 defines the door. In such a structure a continuous elongate hinge structure is formed at the juncture of such wall and door, whereby a continuous seal may be formed by an elongate gasket 50 running the length of the door.

In such structures the hinge assembly 10 including the related panel portions 16 and 22 are conveniently formed as extrusions of aluminium or the like, and in particular may represent elongate extrusions in which the gasket 50 and sealing surface 68 are elongate and co-extensive in length with the extruded parts and with the opening to be closed.

It will be understood that the roles of the components of hinge assemblies 10 and 110 may be reversed. Thus member 12 may be the swingable component when member 14 is the stationary component.

It will be observed that in accordance with the invention the sealing gasket is located remote from and does not interfere with the hinge function.

What I claim as my invention is:

1. A pinless releasable hinge assembly, comprising:

a first member and a second member, one of said first and second members being a stationary member and the other of said first and second members being a hingedly swingable member, said first member having a cavity therein with an inner curved mating surface, a retaining flange at a first end of said inner mating surface, an entrance slot to said cavity defined between said retaining flange and a second end of said inner mating surface, said second member having a hooked portion with an outer curved mating surface, said hooked portion having an outer end, said outer mating surface mating with said inner mating surface in a closed configuration in which said outer end abuts said retaining flange, one of said retaining flange and said outer end being hingedly swingable along a generally arcuate path relative to the other from said closed configuration to define a plurality of open configurations along said arcuate path, a limiting release configuration on said arcuate path at which said hooked portion is releasably removable through said slot, said hooked portion being captive in said cavity between said closed configuration and said limiting release configuration, resilient seal means on one of said first and second members, remote from said inner and outer mating surfaces, and abutment means on the other of said first and second members, said seal means resiliently sealingly engaging said abutment means in said closed configuration.

2. An assembly according to claim 1, wherein said arcuate path encloses an angle of 90° between said limiting release configuration and said closed configuration.

3. An assembly according to claim 1, wherein said arcuate path encloses an angle of 135° between said limiting release configuration and said closed configuration.

4. An assembly according to claim 2, wherein said first and second members include first and second generally planar portions, respectively; said first portion having a first planar surface and said second member having a second planar surface, said first and second planar surfaces being coplanar in said closed configuration.

5. An assembly according to claim 3, wherein said first and second members include first and second generally planar portions, respectively; said first portion having a first planar surface and said second member having a second planar surface, said first and second planar surfaces being perpendicular in said closed configuration.

6. An assembly according to claim 1, wherein an inner end of said hooked portion terminates in a slot wall spaced from and in generally opposed relationship with said outer end, a variable slot defined between said outer end and said slot wall, said retaining flange being contained within said variable slot in said closed configuration, between said outer end and said slot wall.

7. A hinge assembly according to claim 4, further including a sealing flange on said first member, and said abutment means comprises an abutment flange on said second member, said resilient seal means comprising a sealing gasket mounted on said sealing flange for engagement with said abutment flange in said closed configuration.

8. A hinge assembly according to claim 5, further including a sealing flange on said first member, said resilient seal means comprising a sealing gasket mounted on said sealing flange, and said abutment means comprises a sealing surface on said second member.

9. A hinge assembly according to claim 7, wherein said first and second members are elongate extruded members in which said sealing gasket and abutment flange are co-extensive in length with an opening to be closed at the hinge assembly.

10. A hinge assembly according to claim 8, wherein said first and second members are elongate extruded members in which said sealing gasket and sealing surface are co-extensive in length with an opening to be closed at the hinge assembly.

* * * * *

UNITED STATES PATENT AND TRADEMARK OFFICE

CERTIFICATE OF CORRECTION

PATENT NO. :4,852,213

DATED :August 1, 1989

INVENTOR(S) :Shewchuk

It is certified that error appears in the above-identified patent and that said Letters Patent is hereby corrected as shown below:

Column 1, line 10, "4,308,942" should be --4,308,972--.

Signed and Sealed this

Fourth Day of September, 1990

*Attest:*

HARRY F. MANBECK, JR.

*Attesting Officer*

*Commissioner of Patents and Trademarks*